US008739330B2

(12) United States Patent
Smith et al.

(10) Patent No.: US 8,739,330 B2
(45) Date of Patent: Jun. 3, 2014

(54) TRI-FOLD SOFA

(71) Applicant: Lippert Components, Inc., Goshen, IN (US)

(72) Inventors: Ryan Smith, Goshen, IN (US); Jeremy Seniff, Goshen, IN (US)

(73) Assignee: Lippert Components, Inc., Elkhart, IN (US)

( * ) Notice: Subject to any disclaimer, the term of this patent is extended or adjusted under 35 U.S.C. 154(b) by 0 days.

(21) Appl. No.: 13/751,544

(22) Filed: Jan. 28, 2013

(65) Prior Publication Data

US 2013/0191989 A1 Aug. 1, 2013

Related U.S. Application Data

(60) Provisional application No. 61/592,204, filed on Jan. 30, 2012.

(51) Int. Cl.
*A47C 17/02* (2006.01)
*A47C 17/04* (2006.01)

(52) U.S. Cl.
USPC ..... 5/17; 5/35; 5/36; 5/42.1; 5/43

(58) Field of Classification Search
USPC ..... 5/17, 18.1, 19, 25, 28, 29, 30, 35, 36, 5/38, 39, 42, 42.1, 43, 46.1, 47, 48
See application file for complete search history.

(56) References Cited

U.S. PATENT DOCUMENTS

| | | | | | |
|---|---|---|---|---|---|
| 891,351 | A | * | 6/1908 | Mayer | 5/43 |
| 1,381,293 | A | * | 6/1921 | Freeman | 5/25 |
| 2,287,596 | A | * | 6/1942 | Bell | 5/12.1 |
| 2,534,175 | A | | 12/1950 | Lorenz | |
| 2,582,904 | A | | 1/1952 | Harman | |
| 2,664,574 | A | * | 1/1954 | Newborn | 5/43 |
| 3,345,651 | A | | 10/1967 | Fox | |
| 3,432,203 | A | * | 3/1969 | Cavalli | 297/109 |
| 4,074,371 | A | * | 2/1978 | Lindbloom | 5/13 |
| 4,204,287 | A | | 5/1980 | Lane et al. | |
| 4,365,369 | A | * | 12/1982 | Plume | 5/38 |
| 4,402,096 | A | * | 9/1983 | Atimichuk | 5/17 |
| 4,512,048 | A | * | 4/1985 | Isham et al. | 5/37.1 |
| 4,625,346 | A | * | 12/1986 | Quackenbush | 5/37.1 |
| 4,639,953 | A | | 2/1987 | McElmurry et al. | |

(Continued)

FOREIGN PATENT DOCUMENTS

| | | | |
|---|---|---|---|
| DE | 608156 | C | 1/1935 |
| DE | 1745766 | U | 5/1957 |

(Continued)

*Primary Examiner* — William Kelleher
*Assistant Examiner* — Eric Kurilla
(74) *Attorney, Agent, or Firm* — Barnes & Thornburg LLP

(57) ABSTRACT

A convertible sofa and sofa frame deployable between a sofa orientation and a bed orientation. The frame has a base frame with a seat extension frame comprising a seat frame and a mid-frame pivotally secured to the base frame. Cushioning is on one side of the base frame. A seat back frame is pivotally secured to the base frame, the second cushioning on what is a back side when in the sofa orientation. Removable seat back cushions engage the front side of the seat back frame in the sofa orientation. In the bed orientation, the seat frame is extended, the seat back portion is pivoted horizontally, and the removable seat back cushions are located on the mid-frame between the seat frame and the seat back frame.

10 Claims, 10 Drawing Sheets

(56) References Cited

U.S. PATENT DOCUMENTS

| | | | | | |
|---|---|---|---|---|---|
| 4,672,696 | A * | 6/1987 | Horenkamp | 5/17 | |
| 5,097,544 | A * | 3/1992 | Barabas | 5/13 | |
| 5,479,665 | A | 1/1996 | Cassidy et al. | | |
| 5,505,513 | A * | 4/1996 | Carsner | 296/69 | |
| 5,745,935 | A * | 5/1998 | Arft | 5/13 | |
| 5,787,522 | A | 8/1998 | Swihart | | |
| 5,904,401 | A * | 5/1999 | Alberda et al. | 297/354.13 | |
| 6,082,805 | A | 7/2000 | Gray et al. | | |
| 6,341,392 | B1 | 1/2002 | Mäkinen | | |
| 6,651,274 | B2 | 11/2003 | Swihart et al. | | |
| 6,725,473 | B2 | 4/2004 | Grossman et al. | | |
| 6,904,628 | B2 * | 6/2005 | Murphy et al. | 5/47 | |
| 7,685,655 | B1 | 3/2010 | Delmestri | | |
| 7,748,061 | B2 | 7/2010 | Pine | | |
| 7,827,629 | B1 * | 11/2010 | Guillot | 5/12.1 | |
| 8,011,034 | B2 | 9/2011 | Hoffman et al. | | |
| 2010/0269255 | A1 * | 10/2010 | Kanthasamy | 5/37.1 | |

FOREIGN PATENT DOCUMENTS

| | | | | |
|---|---|---|---|---|
| DE | 8118374.7 | U1 | 3/1982 | |
| DE | 3243200 | A1 * | 5/1984 | A47C 17/13 |
| DE | 202008009315 | U1 | 10/2008 | |
| EP | 477148 | A1 * | 3/1992 | A47C 17/13 |
| EP | 1230877 | A1 | 8/2002 | |
| FR | 726500 | A | 5/1932 | |
| FR | 1010886 | A | 6/1952 | |
| FR | 2488116 | A1 | 2/1982 | |
| FR | 2699798 | A1 | 7/1994 | |
| FR | 2895655 | B1 | 7/2007 | |
| GB | 322522 | A | 12/1929 | |
| GB | 358338 | A | 10/1931 | |
| GB | 365766 | A | 1/1932 | |
| GB | 366171 | A | 2/1932 | |
| GB | 819933 | A | 9/1959 | |
| GB | 823014 | A | 11/1959 | |
| GB | 2079147 | A | 1/1982 | |
| JP | 3062390 | U | 10/1999 | |

* cited by examiner

FIG. 9
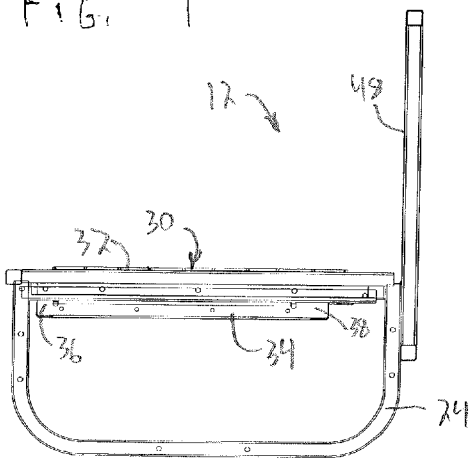
FIG. 10
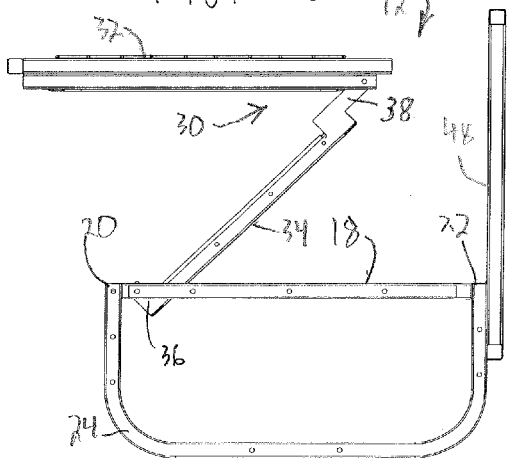
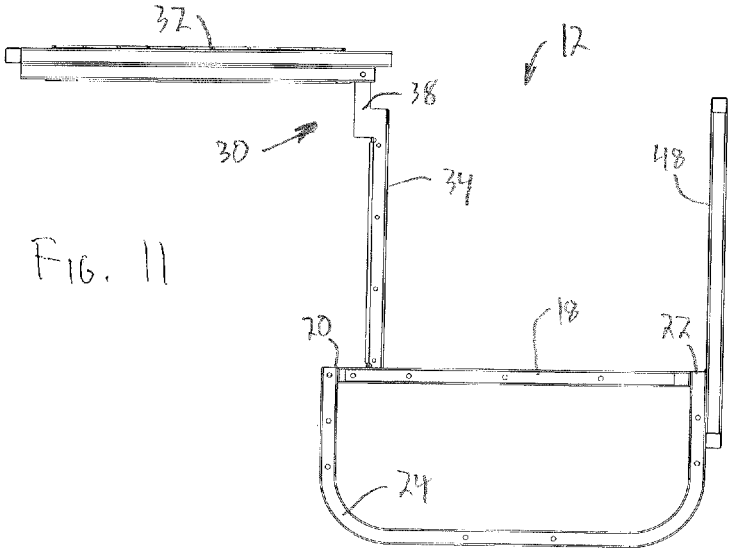
FIG. 11

TRI-FOLD SOFA

RELATED APPLICATION

This application is the non-provisional filing of provisional application No. 61/592,204 filed Jan. 30, 2012.

BACKGROUND OF THE INVENTION

This invention relates to convertible sofas, and in particular to a convertible sofa deployable between a sofa orientation and a bed orientation, and the sofa frame therefor.

Convertible sofas are well known, and have been made and used for over a century. Sophisticated, complex foldable frameworks have been developed, as well as simple readily convertible structures. An example of a simple structure is U.S. Pat. No. 7,685,655. An example of a more complex structure is U.S. Pat. No. 4,204,287.

The present invention has been developed for use in a recreational vehicle, where space normally is very limited, although the invention could be used in any type of dwelling, as well. Given the need for compactness, all elements in the invention are included in the sofa orientation, and are used when it is converted to the bed orientation.

SUMMARY OF THE INVENTION

One aspect of the invention is directed to a convertible sofa frame. The convertible sofa frame comprises a base frame having a first side and a second side, with a seat extension frame pivotally secured to the first side. The seat extension frame comprises a seat frame and a mid-frame, with the mid-frame being pivotally secured on one side edge proximate the first side of the base frame and on an opposite side edge to the seat frame. A seat back frame is pivotally secured to the second side of the base frame, with the seat back frame having an upright position and a prone position. The convertible sofa frame is deployable between a sofa orientation and a bed orientation.

In accordance with the preferred form of the invention, the seat frame of the convertible sofa frame includes a pair of deployable legs. The legs are hingedly secured to the seat frame proximate opposite ends thereof.

In the bed orientation, the seat frame, the mid-frame and the seat back frame are generally co-planar. In the bed orientation, the mid-frame is situated between the seat frame and the seat back frame.

The seat back frame is hingedly secured to the base frame at a median location on the seat back frame. The median location permits proper orientation of the seat back frame when the sofa utilizing the seat back frame of the invention is in the sofa orientation.

The convertible sofa according to the invention is deployable between a sofa orientation and a bed orientation. The convertible sofa has a seating base, and a seat portion shaped to engage the seating base. The seat portion includes a seat frame and first cushioning on one side of the seat frame. A mid-frame is pivotally secured to the seat frame and the seating base. A seat back portion is pivotally secured to the seating base, with the seat back portion having a seat back frame and having second cushioning on a side of the seat back frame opposite the seat portion when the convertible sofa is in the sofa orientation.

In this form of the invention, the seat frame includes at least one deployable leg which is extendable from a side of the seat frame opposite the side on which the first cushioning is located. At least one removable seat back cushion is provided, shaped to engage the seat back frame on a side opposite the second cushioning, when the convertible sofa is in the sofa orientation.

The mid-frame is as in the first form of the invention, where the mid-frame is pivotally secured on one side edge proximate one side of the seating base and is pivotally secured at an opposite side edge to the seat frame.

In accordance with the preferred form of the invention, the mid-frame includes a cushion foundation. The cushion foundation comprises a plurality of spaced slats.

BRIEF DESCRIPTION OF THE DRAWINGS

The invention is described in greater detail in the following description of examples embodying the best mode of the invention, taken in conjunction with the drawing figures, in which:

FIG. 9 is a side elevational view of the convertible sofa frame according to the invention, corresponding to the orientation shown in FIGS. 1 and 2 where the invention is in the sofa orientation, but without any cushioning or covering thereon, FIG. 10 is a side elevational view of conversion of the convertible sofa from the sofa orientation to the bed orientation, corresponding essentially to FIG. 3, FIG. 11 is a further illustration of conversion, corresponding essentially to FIG. 4.

DESCRIPTION OF EXAMPLES EMBODYING THE BEST MODE OF THE INVENTION

FIGS. 1 through 8 illustrate the convertible sofa of the invention, when in the sofa orientation and extending to the bed orientation, and FIGS. 9-16 illustrate the frame therefor. In the following description, reference will be made back and forth between the elements of the convertible sofa and the frame, since it is the frame that gives the convertible sofa the ability to be converted from the sofa orientation shown in FIG. 1 to the bed orientation shown in FIG. 8.

Figure 1:
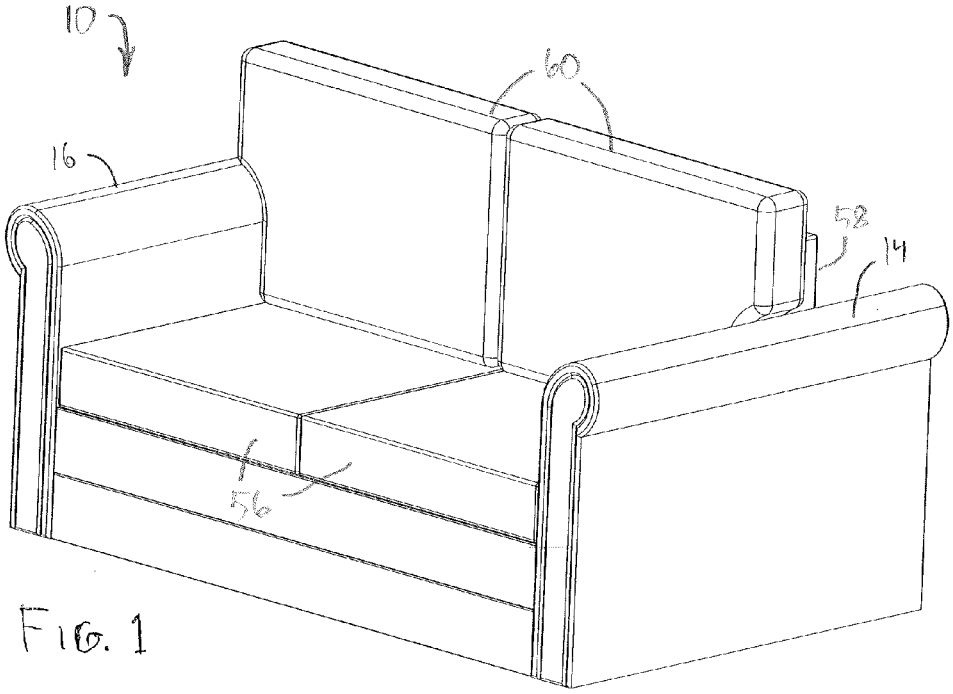
FIG. 1 is an isometric view of a convertible sofa according to the invention, when in the sofa orientation.
Figure 8:
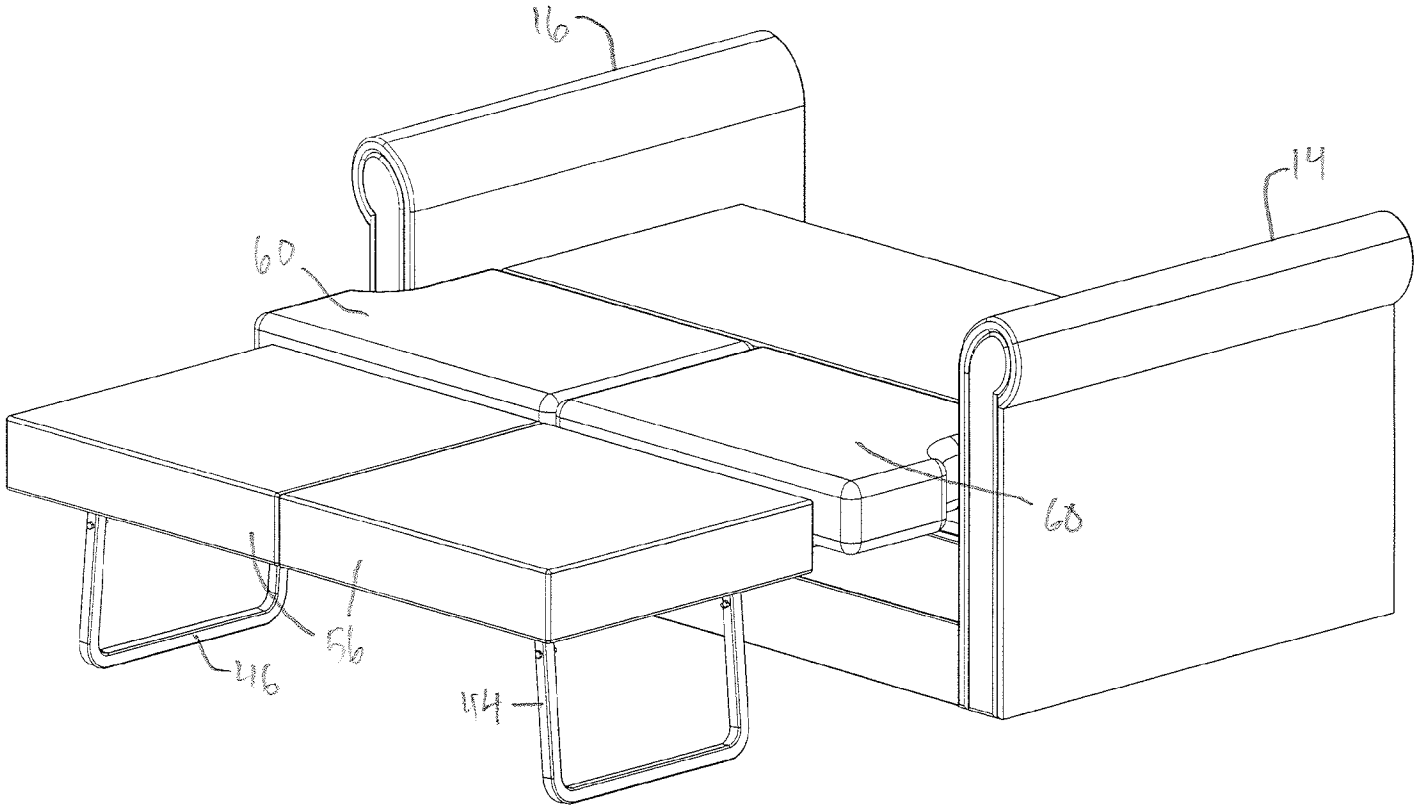
FIG. 8 is a view similar to FIG. 7, but with the seat back cushions returned and placed on the frame, completing the conversion of the convertible sofa to the bed orientation.
Figure 12:
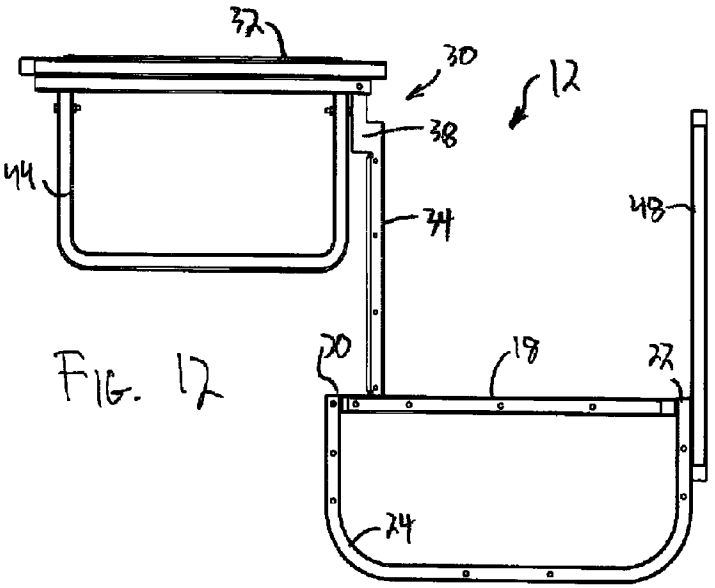
FIG. 12 is a further step in the conversion, corresponding essentially to FIG. 5.
Figure 13:
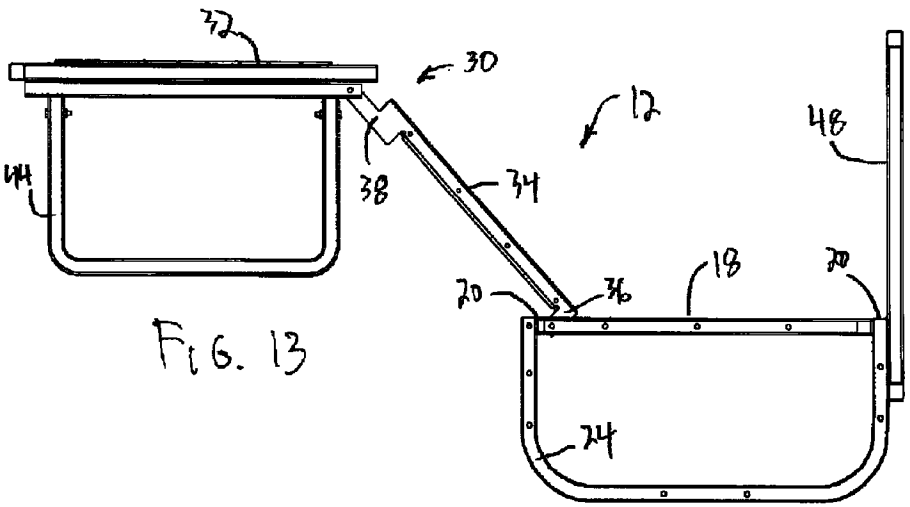
FIG. 13 is yet another step in extending to the bed orientation.
Figure 14:
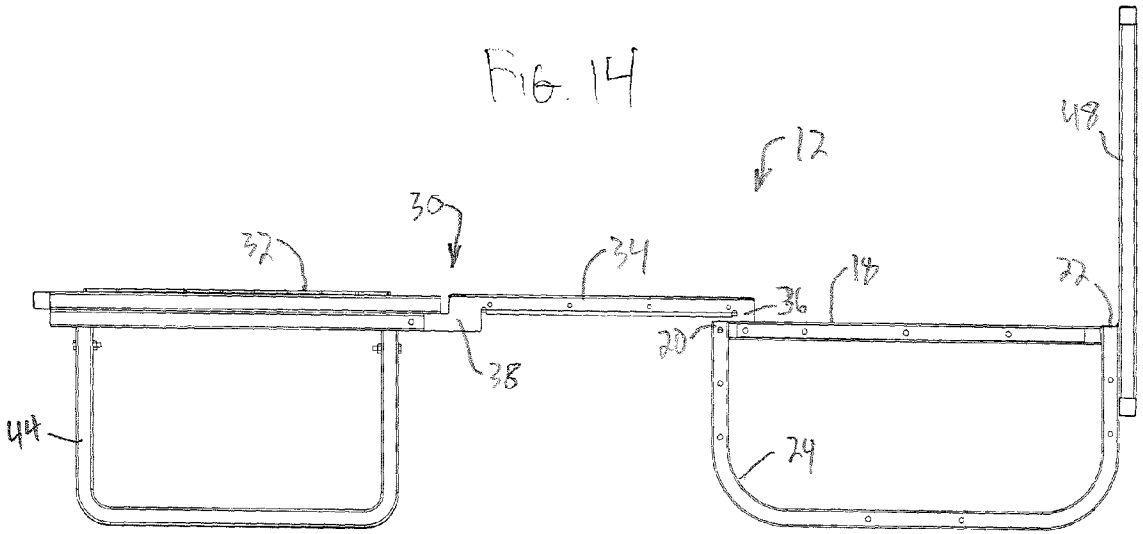
FIG. 14 is a side elevational illustration of the convertible sofa frame, when the seat extension has been fully extended, corresponding essentially to FIG. 6.

A convertible sofa according to the invention is shown generally at 10 in FIG. 1. The corresponding convertible sofa frame for converting a convertible sofa 10 from a sofa orientation shown in FIG. 1 to a bed orientation shown in FIG. 8 is illustrated generally at 12 in FIGS. 9-16. In the preferred form of the invention, the frame 12 is covered with appropriate covering and padding as described in greater detail below, and for the purposes of a sofa, the convertible sofa 10 includes opposite arms 14 and 16 which are appropriately padded and covered with fabric or the like. The arms 14 and 16 are secured to opposite sides of the convertible sofa frame 12 when installed. In other forms of the invention, the arms 14 and 16 may be absent, particularly if space in which the convertible sofa 10 is installed is at a premium. The specific nature of the arms 14 and 16 forms no part of the invention, and the arms 14 and 16, and how they may be connected to the frame 12, are not described in further detail, it being well known to one skilled in the art how to form the arms and connect them to a frame.

Figures 16, 16A:
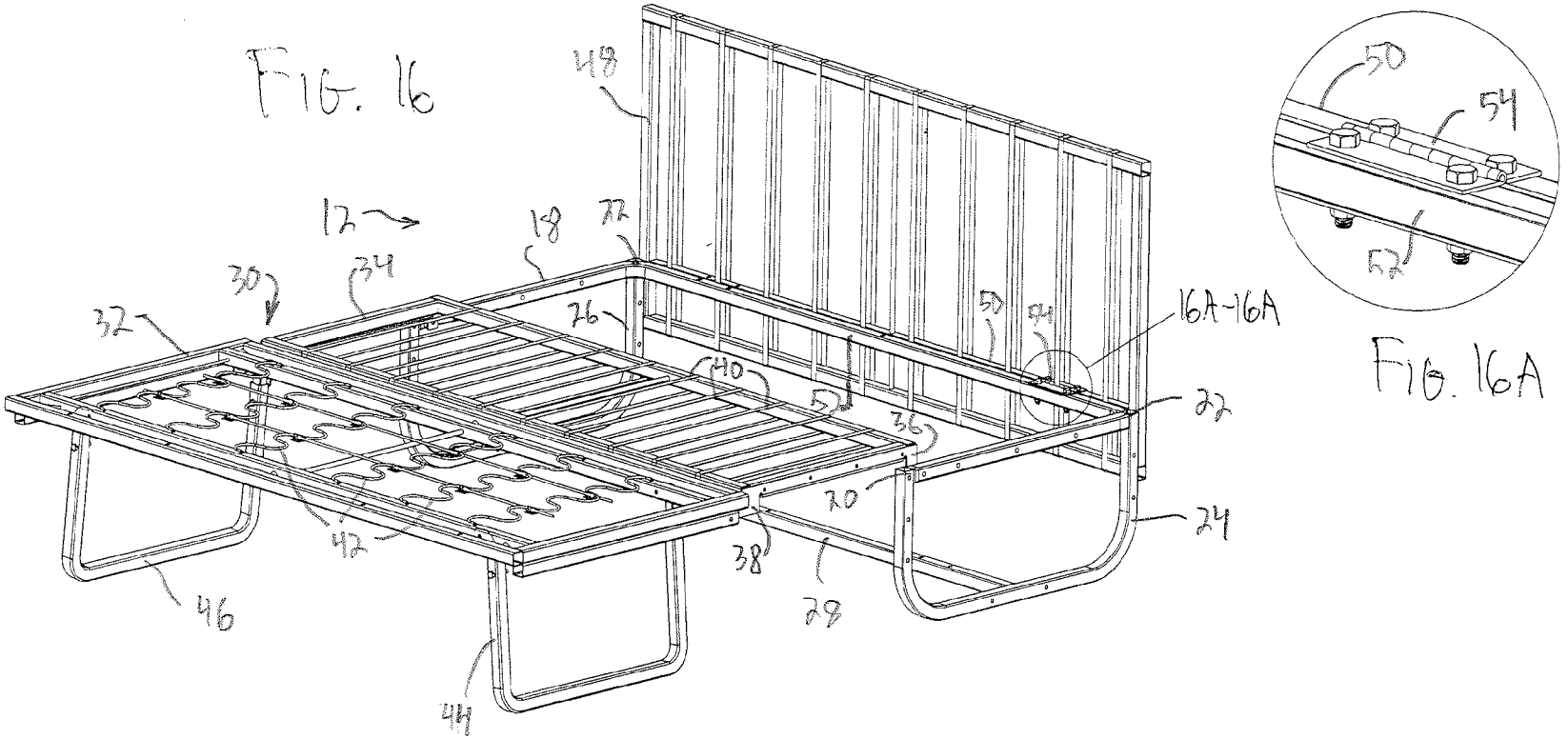
FIG. 16 is a perspective illustration of the convertible sofa frame, corresponding to the orientation of FIGS. 6 and 14.
FIG. 16A is an enlarge illustration of the portion of FIG. 16 illustrated at 16A-16A.

The convertible sofa frame 12 comprises several elements. First, the convertible sofa frame 12 includes a base frame 18 having a first side 20 and a second side 22. As best shown in FIG. 16, the base frame 18 may simply be a peripheral frame upon which other elements of the invention are folded, and the base frame 18 includes legs 24 and 26 which may be interconnected by a horizontal support 28 for rigidity. The elements of the base frame 18 are preferably metal, such as tubular metal, or similar material that is sufficiently robust to support adequate weight borne by the convertible sofa 10.

A seat extension frame 30 is pivotally secured to the first side 20 of the base frame 18. The seat extension frame 30 includes a seat frame 32 and a mid frame 34. As shown in FIGS. 9-16, the mid frame 34 includes an extension 36 which pivotally secures one side edge of the mid frame 34 to the first side 20 of the base frame 18. A further extension 38 pivotally connects the opposite side edge of the mid frame 34 to the seat frame 32. The extensions 36 and 38 of the mid frame 34 may be integral portions of the mid frame 34, or can be separate elements. The extensions 36 and 38 are appropriately shaped so that, when the frame 12 is in the sofa orientation shown in FIG. 9, the mid frame 34 is properly located beneath the seat frame 32 and extending through the base frame 18, and with the seat frame 32 sitting atop the base frame 16. The pivotal connections of the extensions of 36 and 38 to their respective elements of the convertible sofa frame 12 can be rivets, bolts or any connection that allows hinged, pivoting movement as shown in FIGS. 10-15.

The seat frame 32 and the mid frame 34 are formed to support weight bearing thereon. The seat frame 32 supports weight in both the sofa orientation shown in FIG. 1 and the bed orientation shown in FIG. 8. To that end, the mid frame 34 includes a cushion foundation in the form of a plurality of spaced slats 40. While the spaced slats 40 are preferred, other supports, such as a solid surface, a sling, springs or any other means of support could be employed, instead. Similarly, the seat frame 32 includes spaced springs 42 for supporting seat cushions, as described in further detail below. Again, other means of support of seat cushions such as those described immediately above, can be employed, instead.

The seat frame 32 includes a pair of deployable legs 44 and 46. In the sofa orientation, the legs 46 and 48 are folded beneath the seat frame 32. In the bed orientation, the legs 44 and 46 are extended as shown to support the seat frame and the mid frame 34 which extends between the seat frame 32 and the base frame 18. Like the legs 24 and 26, the legs 44 and 46 are preferably formed of metal, in a tubular form, or any other material sufficient to support weight borne by the convertible sofa 10 when in the bed orientation.

A seat back frame 48 is pivotally secured to the second side 22 of the base frame 18 as shown in FIGS. 9-16. The seat back frame 48 has an upright position as shown in FIGS. 9-14, and a prone position shown in FIGS. 15 and 16. The seat back frame 48 is hingedly secured to the base frame 18 at a median location on the seat back frame 48. As best shown in FIGS. 16 and 16A the seat back frame 48 includes a horizontal frame member 50. The base frame 18 includes a horizontal bar 52. Hinges 54 are bolted to the frame member 50 and the bar 52 to facilitate the pivotal movement of the seat back frame 48. While a single hinge 54 is shown in detail, at least a pair of such hinges 54 is utilized for proper pivoting of the seat back frame 48 between the upright position and the prone position. Also, as is evident from the geometry of the seat back frame 48, the upright orientation of FIGS. 9-12 is facilitated by the lower portion of the seat back frame 48 beneath the frame member 50 bearing against the legs 24 and 26 of the base frame 18.

Figure 15:
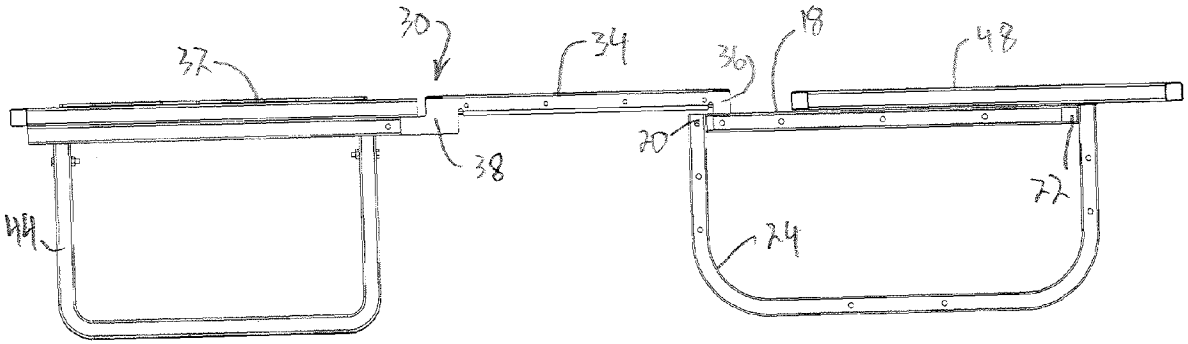
FIG. 15 is a further view thereof, with the seat back frame pivoted to the prone orientation, corresponding essentially to FIG. 7.

When the convertible sofa frame is in the bed orientation, and as best shown in FIGS. 15 and 16, the seat frame 32, the mid frame 34 and the seat back frame 48 are generally coplanar. In that orientation, the mid frame 34 is located between the seat frame 32 and the seat back frame 48.

The convertible sofa 10 is appropriately clad with fabric or other material to aesthetically cover the convertible sofa frame 12. How that is done forms no part of the invention. The convertible sofa 10 also includes first seat cushioning 56 secured to the seat frame 32. The seat cushioning 56 may be separate cushions, as illustrated, or a single cushion. Preferably, the seat cushioning 56 is appropriately affixed to the seat frame 32, although, if desired, the cushioning 56 can be removable.

Second cushioning 58 is mounted on the seat back frame 48. The cushioning 58 is on the "back" side of the seat back frame 48; that is, the cushioning 58 is on a side of the seat back frame opposite the seat cushioning 56 when the convertible sofa is in the sofa orientation shown in FIGS. 1 and 2. Removable seat back cushions 60 are shaped to engage the opposite or "front" side of the seat back frame 48 opposite the cushioning 58 when the convertible sofa 10 is in the sofa orientation shown in FIG. 1. The seat back cushions 60 are shaped aesthetically to form a back support for the convertible sofa 10 in the sofa orientation shown in FIG. 1, and are also sized to be a third cushioning forming the bed orientation of the convertible sofa 10, as described below.

Figure 2:
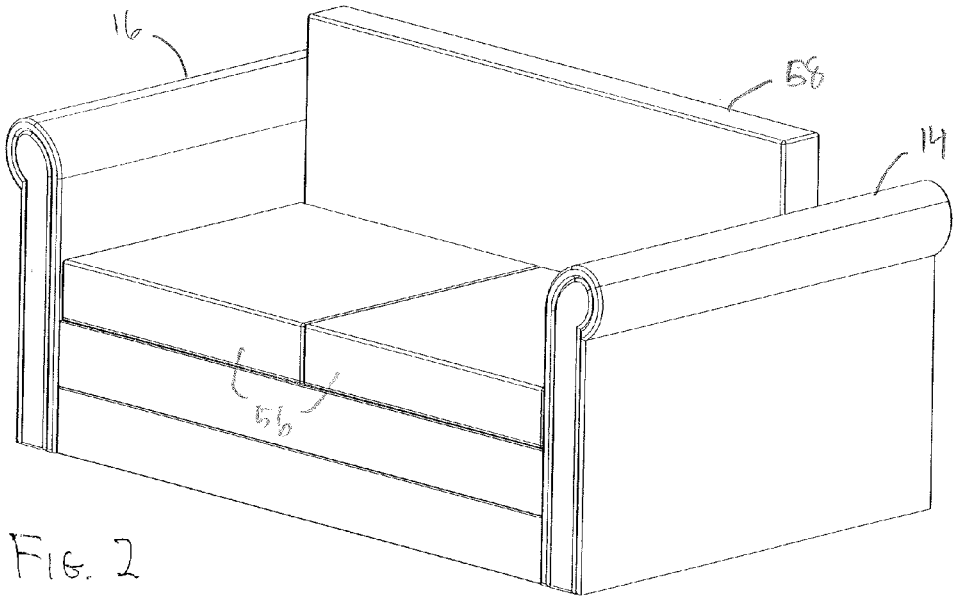
FIG. 2 is a view similar to FIG. 1, but with the seat back cushions removed.
Figure 3:
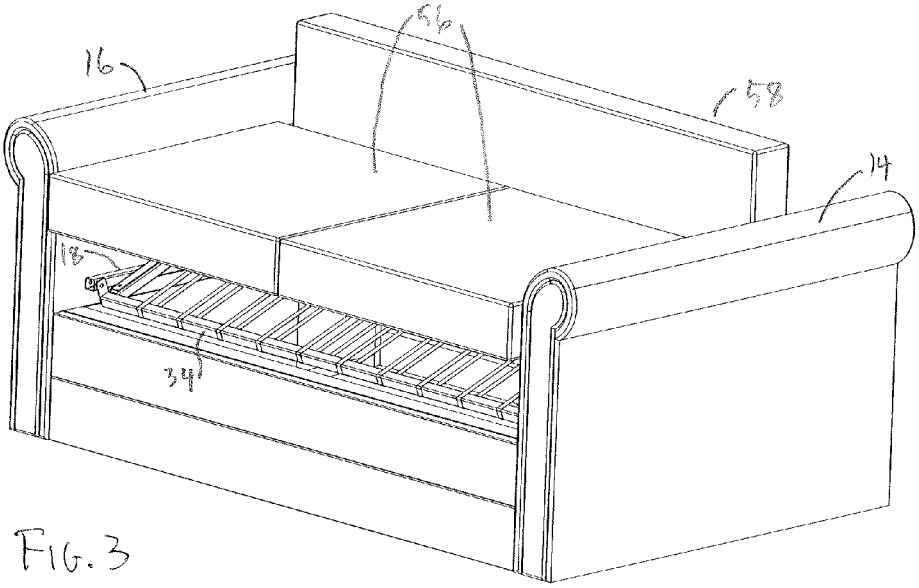
FIG. 3 is a view similar to FIG. 1 and showing commencement of conversion of the sofa from the sofa orientation to the bed orientation.
Figure 4:
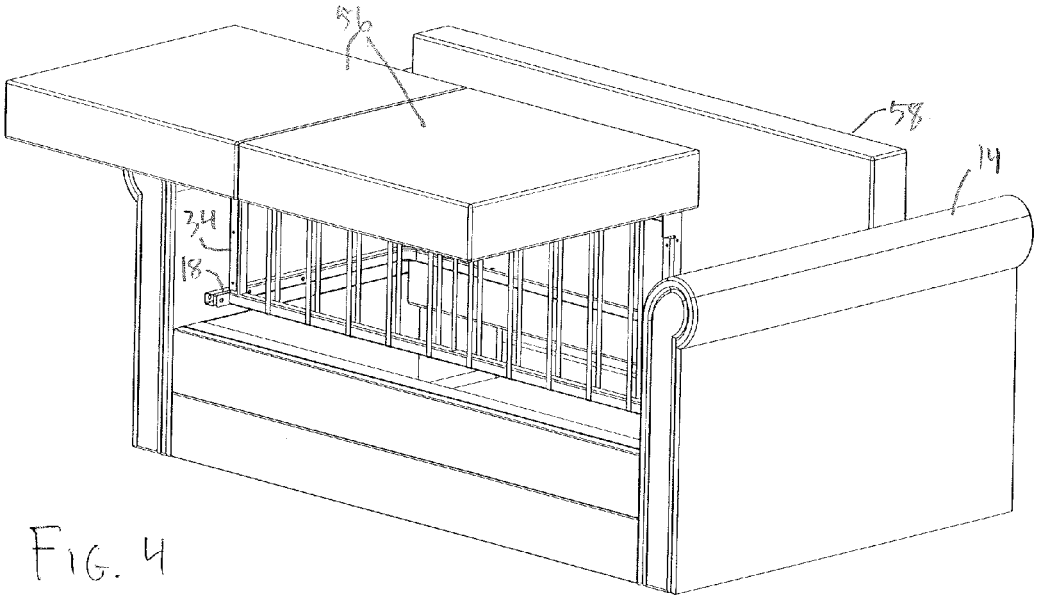
FIG. 4 is a view similar to FIG. 3, as the conversion progresses, and before extension of the deployable legs.
Figure 5:
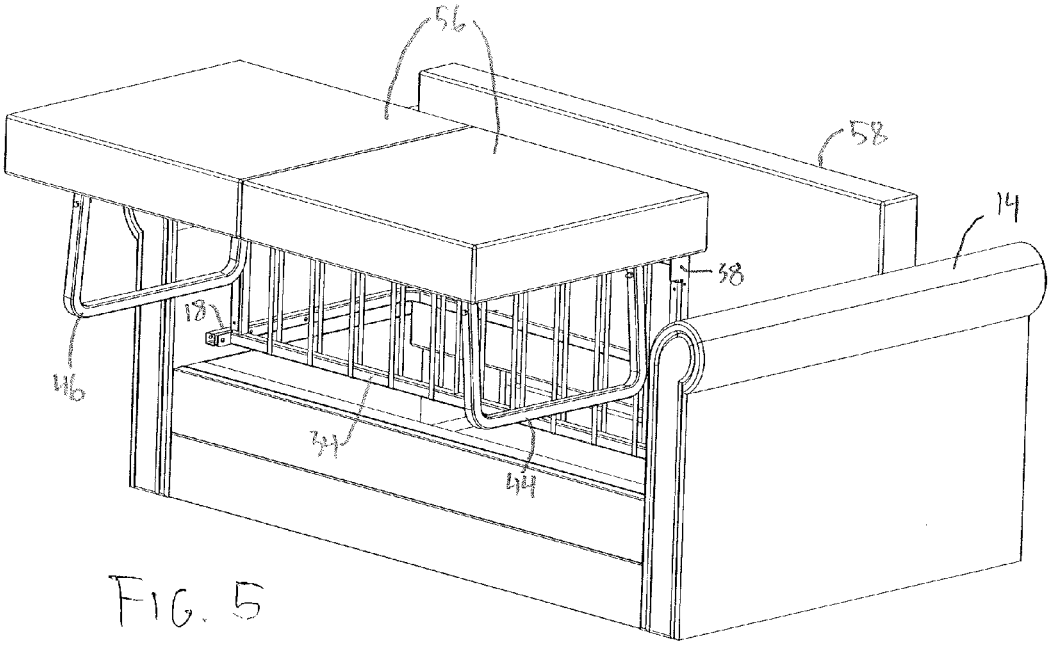
FIG. 5 is a view similar to FIG. 4, with the deployable legs extended.

Steps of converting the convertible sofa 10 from the sofa orientation shown in FIG. 1 to the bed orientation shown in FIG. 8 are illustrated in FIGS. 2-7. In FIG. 2, the seat back cushions 60 have been temporarily removed. Then, in FIG. 3, commencement of moving the seat extension frame 32 to the bed orientation is shown, continuing in FIG. 4, and with extension of the legs 24 and 26 shown in FIG. 5.

Figure 6:
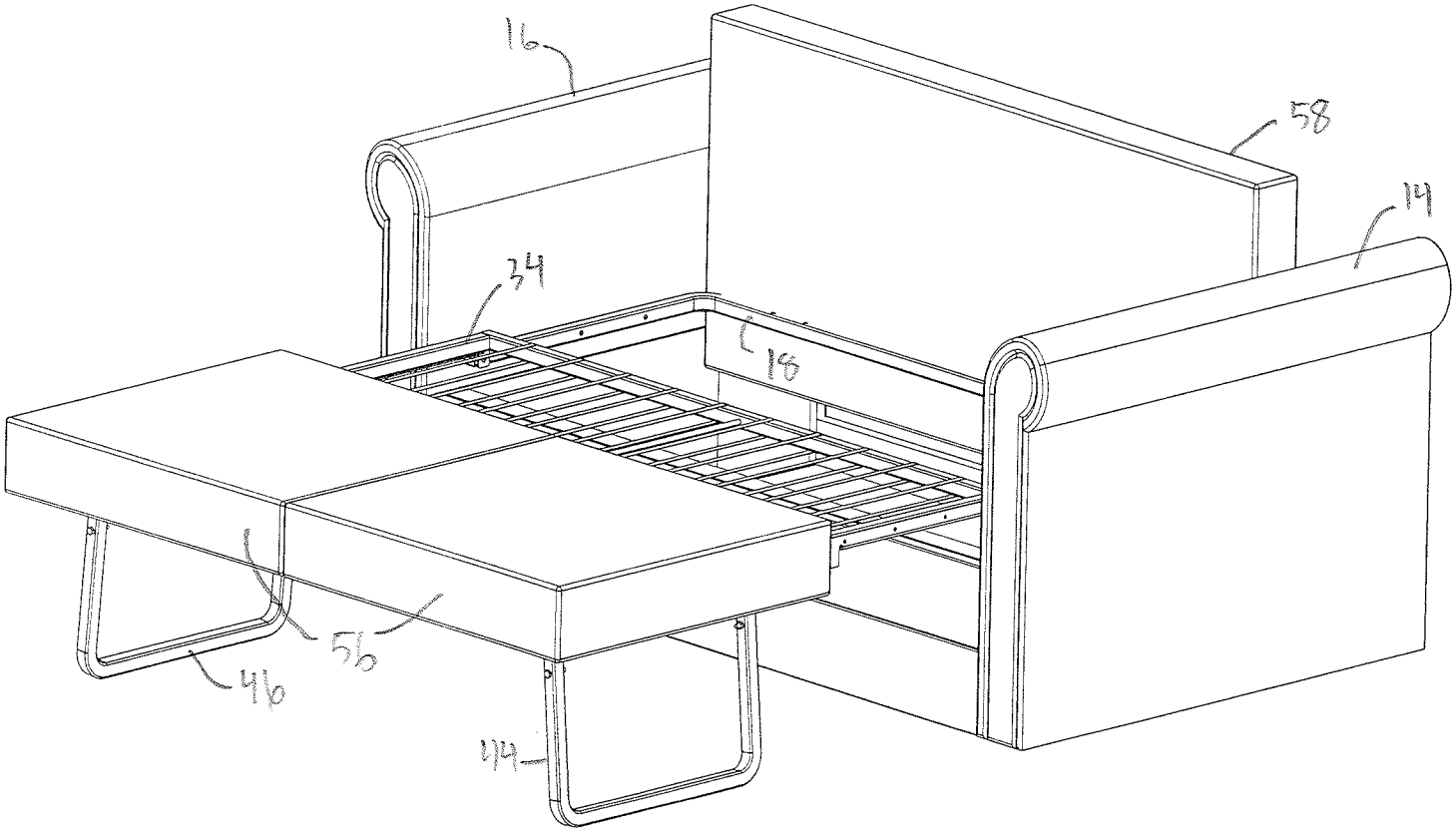
FIG. 6 is a further view of the conversion to the sofa orientation, with the seat frame fully extended, but with the seat back portion upright.
Figure 7:
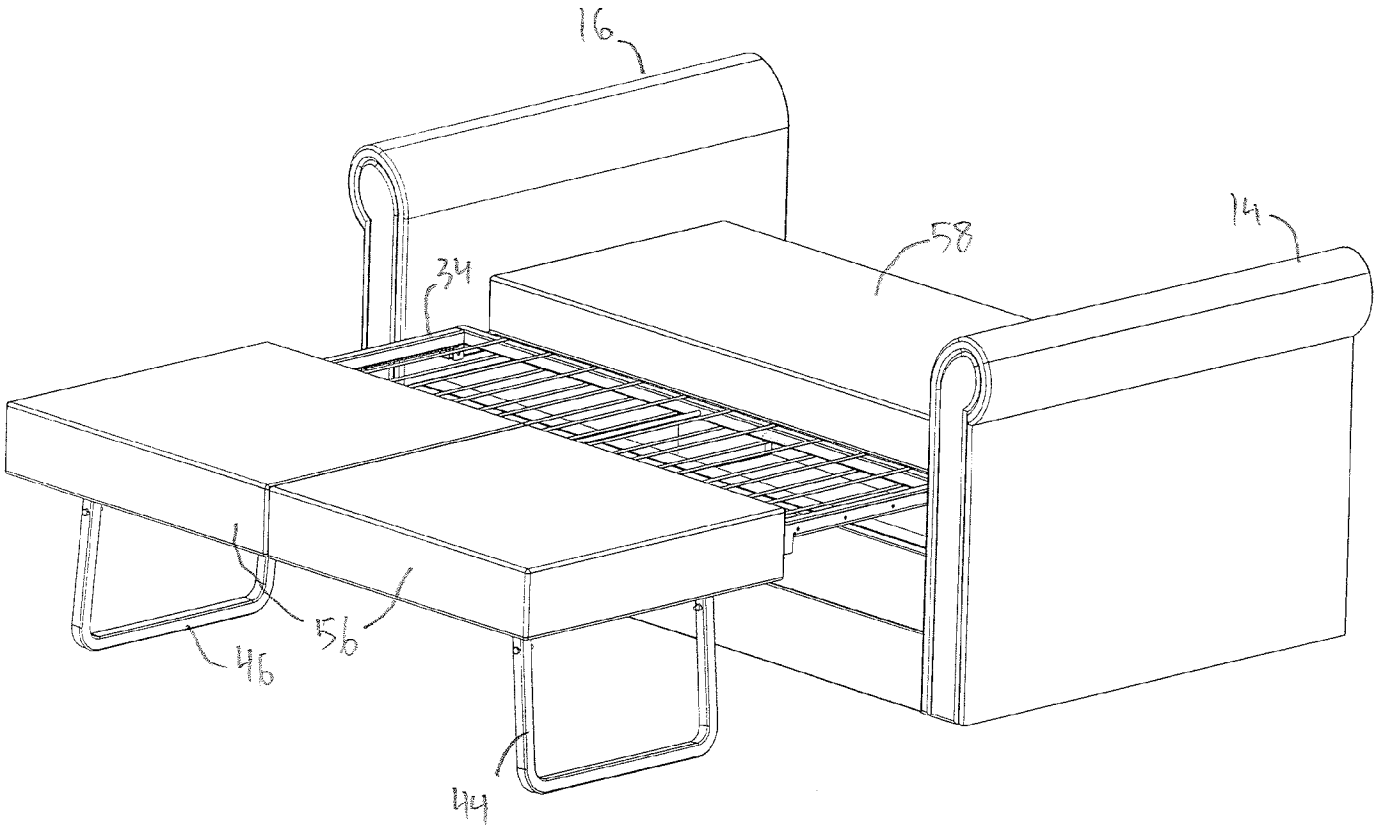
FIG. 7 is a view similar to FIG. 6, but with the seat back portion pivoted to the bed orientation.

In FIG. 6, the seat extension frame 30 has been extended fully in the bed orientation, and in FIG. 7, the seat back frame 42 with the seat cushioning 58 was pivoted to the horizontal or prone position. In FIG. 7, the mid frame 34 is in a gap between the cushioning 56 and the cushioning 58. The gap is filled by placing the seat back cushions 60 between the cushioning 56 and the cushioning 58, completing the sleeping surface of the convertible sofa 10 in the bed orientation shown in FIG. 8.

The bed can then be completed with appropriate bed clothing (not illustrated) as required by the user.

Because the seat frame 32, mid frame 34 and seat back frame 48 are essentially co-planar in the bed orientation as shown in FIGS. 15 and 16, their respective cushioning 56, 60 and 58 is also essentially co-planar, providing a comfortable sleeping surface formed of three sets of cushioning. Preferably, only the seat back cushions 60 are removable from the convertible sofa 10 so that the seat back cushions 60 are properly sandwiched between the cushioning 56 and the cushioning 58 in the bed orientation. As will be evident from the geometry of the invention, the seat back cushions 60 should be formed in size and thickness to fit snuggly between the cushioning 56 and 58 in the bed orientation and create an essentially planar sleeping surface.

Various changes can be made to the invention without departing from the spirit thereof or scope of the following claims.

What is claimed is:

1. A convertible sofa deployable between a sofa orientation and a bed orientation, comprising:

a seating base, a seat portion shaped to engage said seating base, said seat portion including a seat frame and first cushioning on one side of said seat frame, a mid frame, said mid frame being pivotally secured to said seat frame and said seating base, a seat back portion pivotally secured to said seating base, said seat back portion having a seat back frame and having second cushioning on a side of said seat back frame opposite said seat portion when the convertible sofa is in the sofa orientation, and at least one removable seat back cushion shaped to engage said seat back frame on a side opposite said second cushioning, wherein said mid frame is in a first orientation when said convertible sofa is in said sofa orientation and said mid frame is in a second orientation which is inverted with respect to said first orientation when said convertible sofa is in said bed orientation.

2. A convertible sofa deployable between a sofa orientation and a bed orientation, comprising:

a seating base, a seat portion shaped to engage said seating base, said seat portion including a seat frame and first cushioning on one side of said seat frame, at least one deployable leg on said seat frame on a side opposite said one side, a mid frame, said mid frame being pivotally secured to said seat frame and said seating base, a seat back portion pivotally secured to said seating base, said seat back portion having a seat back frame and having second cushioning on a side of said seat back frame opposite said seat portion when the convertible sofa is in the sofa orientation and at least one removable seat back cushion shaped to engage said seat back frame on a side opposite said second cushioning in the sofa orientation, and shaped to engage said mid frame in the bed orientation, wherein said mid frame is in a first orientation when said convertible sofa is in said sofa orientation and said mid frame is in a second orientation which is inverted with respect to said first orientation when said convertible sofa is in said bed orientation.

3. The convertible sofa frame according to claim 2, in which said seat frame includes a pair of deployable legs.

4. The convertible sofa frame according to claim 3, in which said legs are hingedly secured proximate opposite ends of said seat frame.

5. The convertible sofa frame according to claim 2, in which, in the bed orientation, said seat frame, said mid frame and said seat back frame are generally co-planar.

6. The convertible sofa frame according to claim 2, in which, in the bed orientation, said seat back cushion further is shaped to extend between said first cushioning and said second cushioning.

7. The convertible sofa frame according to claim 6, in which, in the bed orientation, said first cushioning, said seat back cushioning and said second cushioning are generally co-planar.

8. The convertible sofa frame according to claim 2 in which said mid frame is pivotally secured on one side edge proximate one side of said seating base and said mid frame is pivotally secured at an opposite side edge to said seat frame.

9. The convertible sofa frame according to claim 8, in which said mid frame includes a cushion foundation.

10. The convertible sofa frame according to claim 2, in which said seat back frame is hingedly secured to said seating base at a median location on said seat back frame.

* * * * *

UNITED STATES PATENT AND TRADEMARK OFFICE

CERTIFICATE OF CORRECTION

PATENT NO. : 8,739,330 B2
APPLICATION NO. : 13/751544
DATED : June 3, 2014
INVENTOR(S) : Smith et al.

It is certified that error appears in the above-identified patent and that said Letters Patent is hereby corrected as shown below:

In the Claims

Claim 3, at column 6, line 20, delete the word "frame" after the words "convertible sofa";

Claim 4, at column 6, line 22, delete the word "frame" after the words "convertible sofa";

Claim 5, at column 6, line 25, delete the word "frame" after the words "convertible sofa";

Claim 6, at column 6, line 28, delete the word "frame" after the words "convertible sofa";

Claim 7, at column 6, line 32, delete the word "frame" after the words "convertible sofa";

Claim 8, at column 6, line 36, delete the word "frame" after the words "convertible sofa";

Claim 9, at column 6, line 40, delete the word "frame" after the words "convertible sofa";

Claim 10, at column 6, line 42, delete the word "frame" after the words "convertible sofa".

Signed and Sealed this
Sixth Day of January, 2015

Michelle K. Lee

Michelle K. Lee
*Deputy Director of the United States Patent and Trademark Office*